United States Patent [19]

Kinney

[11] 4,044,213

[45] Aug. 23, 1977

[54] PUSH-BUTTON SENSOR SWITCH

[75] Inventor: Dwayne R. Kinney, Minnetonka, Minn.

[73] Assignee: International Telephone and Telegraph Corporation, New York, N.Y.

[21] Appl. No.: 709,328

[22] Filed: July 28, 1976

[51] Int. Cl.[2] ..... H01H 9/16

[52] U.S. Cl. ..... 200/308; 200/61.02; 250/229

[58] Field of Search ..... 200/DIG. 36, 61.02, 200/308; 338/15, 16, 17, 18, 19; 250/229, 237 R; 340/365 P

[56] References Cited

U.S. PATENT DOCUMENTS

| | | | |
|---|---|---|---|
| 3,538,332 | 11/1970 | Gilbert | 250/229 X |
| 3,715,548 | 2/1973 | Schadow | 200/311 |
| 3,855,959 | 12/1974 | Hinze | 200/308 |

*Primary Examiner*—J. V. Truhe
*Assistant Examiner*—D. A. Tone
*Attorney, Agent, or Firm*—James B. Raden; William J. Michals

[57] ABSTRACT

A push-button sensor switch for controlling and indicating the output of an integrally mounted sensor element is disclosed. The switch includes a frame having a contact stack mounted thereto and which is under the control of a reciprocating plunger extending therefrom. A hollow push-button head housing is attached to the end of the plunger for reciprocal movement therewith. A signal surface member is mounted to the frame and extends into the housing and is visible from a window at the end of the housing. A light sensitive resistor sensor is mounted within a recess in the body of the signal surface member and is therefore located a given fixed distance from the contact stack. A pair of shutters are pivotally mounted within the housing adjacent the window and are engaged by the signal surface member to rotate in response to relative movement of the housing with respect to the signal surface, thereby to alternately conceal and expose the sensor. The output terminals of the sensor are coupled to a pair of contacts on the contact stack. The movement of the housing and therefore the shutters controls the output of the sensor, and the shutters and the signal surface function to provide a visual indication of the output state of the sensor including aliphanumeric indicia thereof.

12 Claims, 15 Drawing Figures

PUSH-BUTTON SENSOR SWITCH

BACKGROUND OF THE INVENTION

The present invention relates to push-button sensor switches and, more particularly, to a push-button sensor switch for controlling and indicating the output of a cooperating integrally mounted sensor element therein.

Push-button switches, including lighted switches, are well known and have been widely used in the art. A commercially highly successful improvement in the art of push-button switches has been the non-lighted, shuttered switch wherein a light reflecting signal surface is alternately exposed and concealed by the shutters in response to reciprocal movement of the button head which is mounted to the switch plunger. These switches provide a passive but dramatic indication of the operative switch position and otherwise avoid the need for a powered light bulb or other active indicating device, and have accordingly achieved substantial market acceptance. Switches of this type are exemplified in the U.S. Pat. to Schadow- No. 3,715,548, which is assigned to the same assignee as the present invention. These switches have also achieved significant market acceptance in the television and home products industry because of their cost and power savings, reliability, and physical attractiveness.

In this industry, light controlled resistor sensors have been provided on the control panel, or other suitable surface, of the television receiver. These sensors are used with associated utilization circuitry to automatically control the brightness levels of the picture tube, cathode ray tube (CRT), in response to varying levels of ambient illumination. That is, in a brightly lit room, a greater CRT intensity is required to provide desired levels of contrast. On the other hand, in a partially or fully darkened room, it has been found that reducing the intensity of the CRT tube is particularly desirable. Thus, these sensor systems function to provide an automatic brightness control.

To satisfy the needs of these sensor systems, separate switches, including push-button switches to control the output of the light sensors or the cooperating utilization circuitry have been proposed. This then provides the consumer with the option of utilizing the automatic brightness control selectively. That is, there are instances when it is desirable to override the function of the automatic brightness control as when an abnormal light condition exists in the viewing room. For example, a flickering or concentrated light source may prevail in the vicinity of the television receiver such that the unusual light source would adversely impact, or erroneously affect, the operation of the automatic brightness control.

It will be appreciated that the provision of a separate light sensor element, including the lens or other optics associated therewith, and a separate switch to control the operation thereof, suffers with the disadvantages of such multiplicity. Moreover, in a given product line, there are typically models which delete the structure of, and the functions provided by, these sensor devices or accessories for reasons of cost and other marketing considerations. Accordingly, several control panels must be provided to accommodate the different models, or the control panel bezel must be produced in a universal manner so as to accomodate the different models within a given product line. This has the disadvantages of increased tooling and inventory costs, and that the unused bezel openings must be suitably and attractively filled with compatible structure.

These and other disadvantages are overcome by the present invention wherein a non-lighted, shuttered and reciprocally operated push-button sensor switch is provided which controls and indicates the output of an integrally mounted sensor element by means of the cooperation between the switch housing, the mechanical shutters and the sensor element. The sensor switch, in accordance with the present invention, facilitates, notably, a controlled light sensitive resistor sensor which is particularly suitable for use in automatic brightness control systems for television receivers.

SUMMARY OF THE INVENTION

Briefly, a push-button sensor switch for controlling and indicating the output of an integrally mounted sensor element is provided. The switch includes a body having a frame in which a switch plunger is slidably mounted for reciprocal movement to operate at least one set of contacts mounted to the frame. A push-button head housing is attached to the outer end of the plunger for reciprocal movement therewith and the housing includes a viewing window at its outer end thereof. A fixed member is attached to the frame and extends into the housing and includes a forward portion having a signal surface area thereon which is visible through the viewing window. The signal surface is positioned either adjacent to or spaced apart from the viewing window in response to the reciprocal movement of the housing. Means are provided for mounting the sensor to the forward portion of the fixed member whereby the distance between the electrodes of the sensor and the switch contacts is fixed. At least one shutter member is rotatably mounted within the housing adjacent the viewing window and is engaged by the fixed member for rotation between first and second positions in response to relative movement between the fixed member and the housing. Accordingly, the shutter exposes the sensor when the fixed member is adjacent the viewing window and conceals the sensor when the fixed member is spaced apart from the viewing window. Finally, means are provided for electrically coupling the electrodes of the sensor with the contacts of the switch frame to control the output of the sensor in response to movement of the housing.

BRIEF DESCRIPTION OF THE DRAWING

The advantages of this invention will become more readily appreciated as the same becomes completely understood by reference to the following detailed description when taken in conjunction with the accompanying drawing wherein.

DETAILED DESCRIPTION

Figure 1:
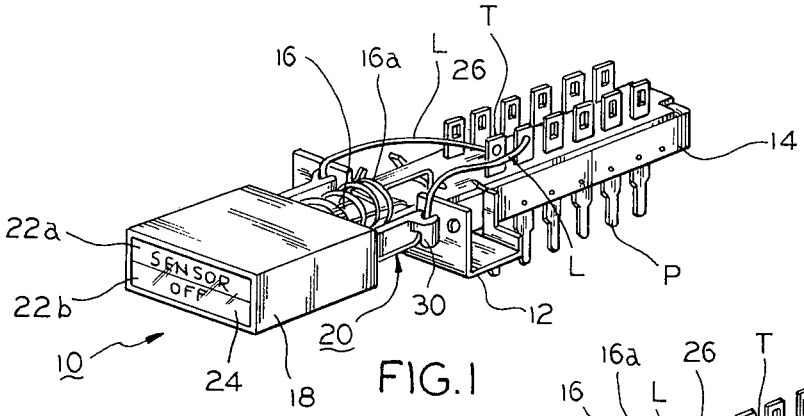
FIGS. 1 and 2 provide similar perspective views of a push-button sensor switch in accordance with the principles of the present invention and illustrate the sensor-off and sensor-on modes thereof.
Figure 2:
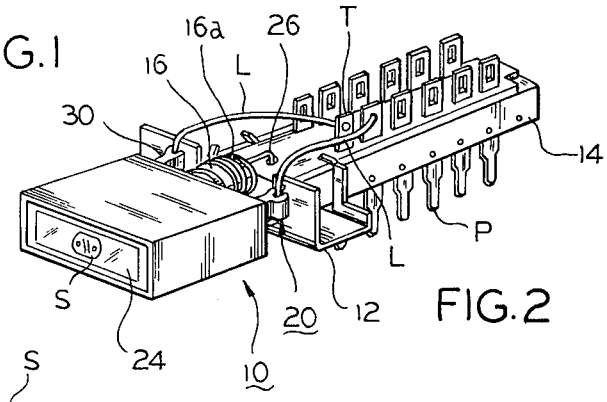

Referring now to FIGS. 1 and 2, there is shown generally at 10 a push-button sensor switch in accordance with the present invention. Switch 10 includes a frame 12 upon which is mounted a contact stack 14 in which a reciprocating plunger 16 is slidably mounted to facilitate the various switched functions. Switch 10 includes a push-button head 18 which is attached to the end of plunger 16. A signal surface member 20 is fixedly mounted to frame 12 as by snap-in locking means as described more fully hereinafter.

Still referring to FIGS. 1 and 2, it can be seen that switch 10 is provided with a pair of shutters **22*a* and 22*b* which are illustrated in their closed positions in FIG. 1. The shutters are rotatably mounted within head 18 for engagement with member 20 as will be described more fully hereinafter. Head 18 further includes a front viewing portion or opening which may include a lens such as a clear or transparent lens 24. Shutters 22*a* and 22*b* may include printed indicia thereon, such as by hot stamping, as illustrated in FIG. 1.**

The basic structure and operation of shuttered switches of the general type illustrated in FIGS. 1 and 2 are illustrated and described in the above-identified patent to which reference may be had for a more detailed explanation.

As illustrated in FIG. 2, switch 10 further includes a sensor element S which may comprise a light sensitive resistor, a photo resistor, a photo cell or any other suitable transducer to meet the requirements of a given application. As will be described more fully hereinafter, the terminals or electrodes of sensor S are coupled to a selected pair of closure contacts of contact stack 14 by way of wires or leads L. The leads are preferably soldered to upstanding terminals, as at T. The terminals T may be further soldered or otherwise connected to an external utilization device such as an automatic brightness control circuit. In currently preferred practice, contact stack 14 is further provided with a set of dual in-line pins T to facilitate the coupling of switch 10 to a printed circuit board or other suitable connector device. Plunger 16 is provided with a spring **16*a* disposed thereabout for urging head 18 away from frame 12. A suitable latching device 26 is formed with contact stack 14 to stably maintain switch 10** in either of two selectable switch positions.

Figure 3A:
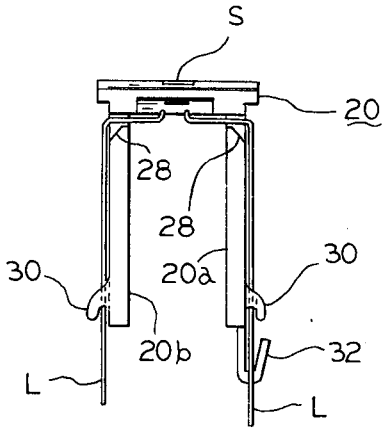
FIGS. 3–5 illustrate various views of the signal surface bearing, fixed member of the switch of FIGS. 1 and 2, which member is provided with means for mounting the cooperating sensor.
Figure 4:
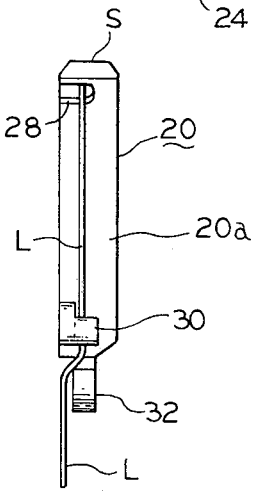
Figure 5:
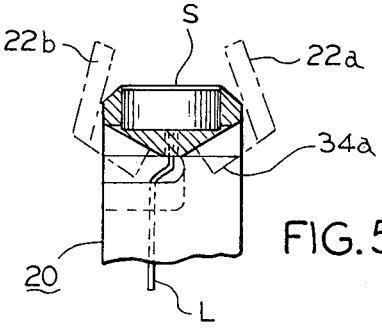

Referring now to FIGS. 3–5, there are shown various views of fixed member 20 in conjunction with sensor S, in accordance with the principles of the present invention. FIG. **3*a* provides a side plan view of member 20 wherein sensor S is flush-mounted within a recess provided in the forward portion or signal surface bearing portion of member 20. The forward portion of member 20 is further provided with a pair of holes extending from the bottom surface of the recess through the remaining structure of the forward portion. These holes accomodate leads L which are dressed horizontally, in FIG. 3*a*, toward suitable guides or cut-out portions 28 of member 20, as best illustrated in FIG. 4. Thence, leads L are dressed downwardly, in FIG. 3*a*, along the projecting legs 20*a* and 20*b* of the generally U-shaped member 20 toward a second pair of guide means 30 which further serve to constrain the leads L to member 20. As best illustrated in FIGS. 1 and 2, the leads L are transversely bent at guide means 30 and are subsequently dressed around the frame 12** for soldered connection to terminals T.

Figure 3B:
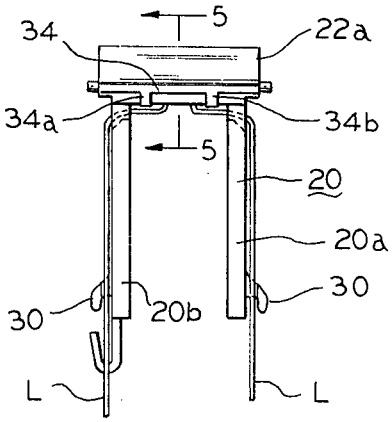

Referring again to FIG. **3*a*, it can be seen that member 20 is provided with a snap-in fastener 32 which is received within a corresponding aperture on the front portion of frame 12 when the switch is assembled. Referring now to FIG. 3*b*, it can be seen that shutter member 22*a* is provided with a cutout portion generally at 34 at one of the limbs of the generally L-shaped shutter member 22*a*. This is done to ensure sufficient clearance during the pivotal operation of the shutter members and, more particularly, to assure proper pivotal operation over a wide range of production tolerances. The remaining limb projections 34*a* and 34*b* function to rotate shutter member 22*a* into its closed position as illustrated somewhat more clearly in FIGS. 6 and 7.**

FIG. 5 is a view taken along the line 5—5 of FIG. **3*b* and is sectioned along the recessed portion of member 22 which accomodates the mounting of sensor S. It can be seen that shutters 22*a* and 22*b* pivot about the forward or transverse portion of member 20 during operation of switch 10, to alternately expose and conceal the signal surface portion of member 20** and therefore the sensor S mounted therein.

Figure 6:
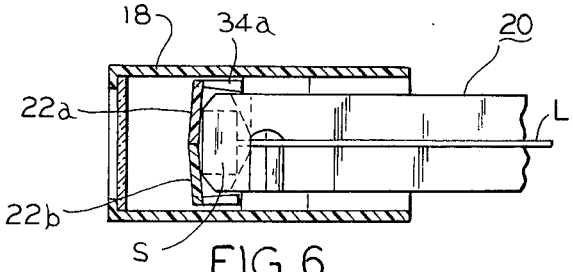
FIGS. 6 and 7 particularly illustrate the operation of the shutters of the sensor switch of the present invention; and, FIGS. 8–14 illustrate similar views of an alternate embodiment of the push-button sensor switch in accordance with the principles of the present invention.
Figure 7:
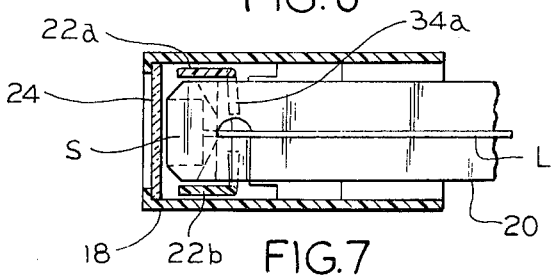

Referring now to FIGS. 6 and 7, there are shown cross-sectional views of the head 18 and member 20 portions of switch 10, illustrating respectively the sensor-off and sensor-on switched positions in accordance with the present invention. That is, when head 18 is in its initial position as illustrated in FIG. 6, the shutter members **22*a* and 22*b* are in their closed position wherein sensor S is substantially concealed thereby. However, as button head 18 is depressed and translated toward member 20, the latter of which being fixedly mounted to frame 12, shutters 22*a* and 22*b* rotate or pivot within head 18 to expose sensor S. It should be appreciated that in the sensor-on position illustrated in FIG. 7, the signal surface portion of member 20 and, more particularly, the sensor S mounted thereon, are located immediately adjacent the window or lens 24 of head 18.**

Figure 8:
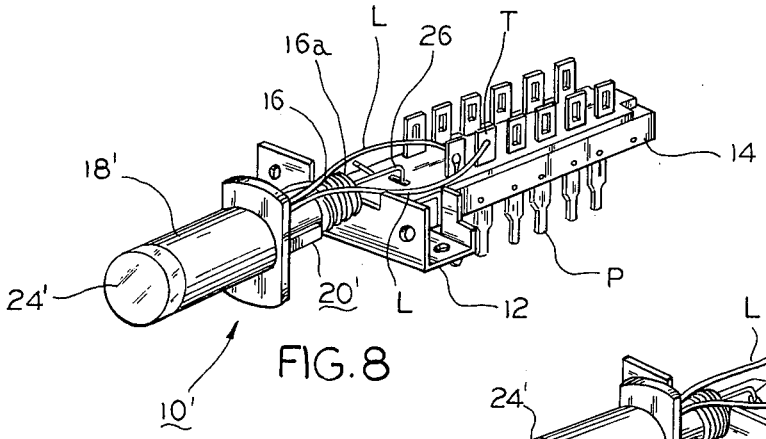
Figure 9:
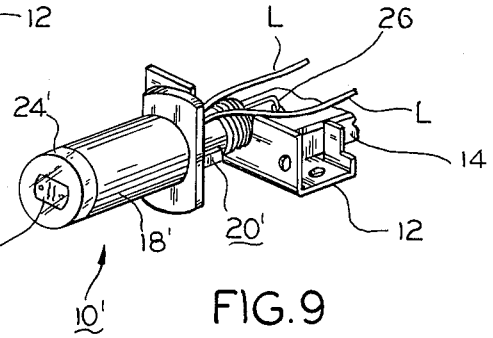

Referring now to FIGS. 8–14, there is shown an alternate embodiment of the push-button sensor switch in accordance with the present invention. Switch 10' is similar to switch 10 of FIGS. 1 and 2 and, accordingly, like elements bear like reference numerals. Any modifications in the structure and/or function of the elements with respect to previously described corresponding elements, is indicated by a prime. Switch 10' of FIGS. 8 and 9 utilizes an essentially identical frame 12, contact stack 14, plunger 16 and spring **16*a*. The basic difference in the embodiment illustrated in FIGS. 8 and 9 is that a generally cylindrical push-button head 18' is provided rather than the generally rectangular head 18 of FIGS. 1 and 2.** Of course, this difference in the head configuration necessitates certain structural changes to cooperating elements as described hereinafter.

Figure 10:
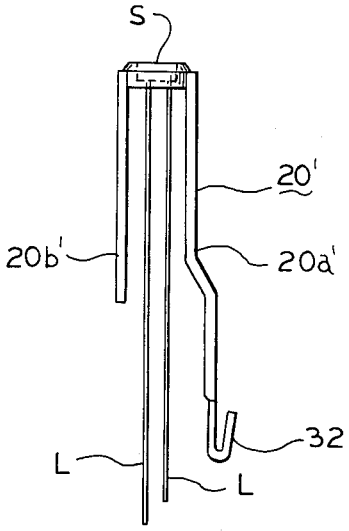
Figure 11:
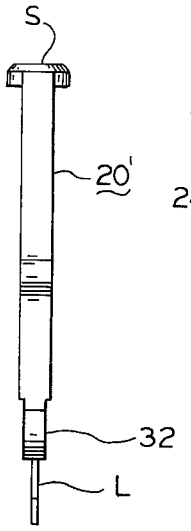
Figure 12:
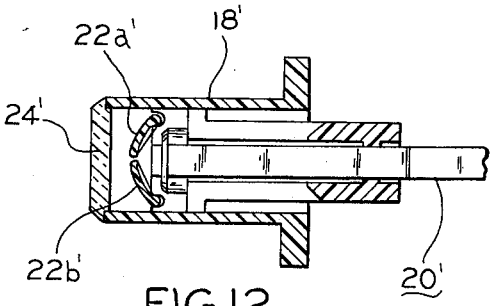
Figure 13:
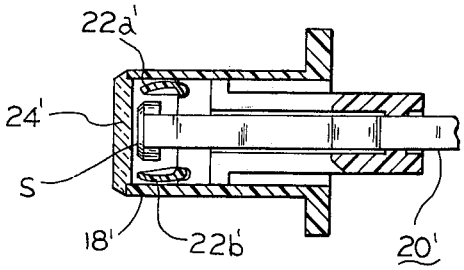
Figure 14:
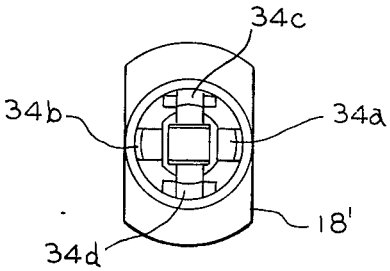

The shutter members **22*a*' and 22*b*' are provided as parabolic members which correspond to the circular cross-section of heat 18'. Fixed member 20' is of similar construction in that a generally U-shaped member is provided having a transverse portion which provides the signal surface and the means for mounting sensor S. It will be noted that snap-in member 32 of FIGS. 10 and 11 is essentially identical to the corresponding member 32 of the previous drawing figures. As illustrated in FIG. 14, head 18' is provided with four generally rectangular bores or apertures as at 34*a–d*. Apertures or bores 34*a* and 34*b* accommodate legs 20*a*' and 20*b*' of member 20' when switch 10' is assembled. It will be noted that member 20' can be inserted in either one of two diametric orientations. That is, leg 20***a'* is readily accomodated in either bore 34*a* or 34*b*. Bores 34*c* and 34*d* are provided to accomodate dressing of leads L in either one of bores 34*c* or 34*d*. Two bores are provided to again facilitate the random orientation of member 20' in head 18', thereby simplifying the assembly thereof.

It will now be appreciated by those skilled in the art that the push-button sensor switch in accordance with the present invention provides several advantages and functions following from the structural relationship of the various cooperating elements. For example, since sensor S is mounted at the forward, visible signal bearing surface of member 20 (and 20'), and since member 20 (and 20') is fixed relative to the switch frame, the sensor S is located immediately adjacent to the window portion of the associated button head or housing when the switch is in the sensor-on position, and the leads which couple the electrodes of sensor S to the switch stack contacts are therefore stationary and fixed. That is, during the sensor-on mode of operation, sensor S is immediately adjacent the window portion and the light impinging thereon is therefore at a maximum value. Further, since the leads L are not subject to flexing during switching operations, the reliability of the sensor switch is significantly enhanced.

It will also be appreciated by those skilled in the art that in applications such as a light sensitive resistor sensor switch, the associated shutters effectively decouple the light from the sensor element to effectively disconnect it from the associated utilization circuitry. Thus, the shutter structure which provides the unlighted feature of the basic switch, also cooperates with the sensor S to provide a means for directly controlling its output. However, in certain given applications, it may be desirable to utilize the function provided by contact stack 14 to ensure a more positive or absolute control function. That is, by providing a contact closure in series with, or in shunt with, the electrodes of sensor S, the sensor element can be electrically isolated from the associated utilization circuitry. Further, a contact closure, as for example a shunt contact, can be utilized to provide a superimposed or dominating signal on the sensor output which, in turn, can be sensed by the associated utilization circuitry to positively revert such utilization circuitry to a desired mode of operation. Furthermore, in a given constructed embodiment, the closed shutters could conceivably pass or leak a residual or finite amount of light which may be undesirable for a given application. In these situations, the operative contact closure, concomitantly provided by the functioning of the sensor switch, can be used to obviate any undesired affects of such residual leakage.

While the previously described push-button sensor switch has been described as having particular utility in automatic brightness control systems for television receivers, it will be appreciated by those skilled in the art that the present invention will also readily find utility in other applications. For example, the sensor switch can be utilized in household dimmer switch applications wherein the sensor switch is utilized to control domestic lighting in accordance with ambient light conditions. The present invention provides many of the same advantages in these other applications. That is, the cooperation between the mechanical operation of the shutters, its resulting effect on the sensor output and the unlighted but dramatic indication provided thereby, as well as the concomitant availability of an operative electrical contact closure, can be advantageously utilized in a number of different applications wherein a switched sensor is required.

What has been taught, then, is a push-button sensor switch facilitating, notably, a light sensitive resistor sensor for use in automatic brightness control systems for CRT devices of television receivers. The forms of the inventions illustrated and described herein are but preferred embodiments of these teachings, in the forms currently preferred for manufacture. They are shown as illustrations of the inventive concepts, however, rather than by way of limitation, and it is pointed out that various modifications and alterations may be indulged in within the scope of the appended claims.

What is claimed is:

1. A push-button sensor switch comprising, in combination:

a switch body having a frame in which a switch plunger is slidably mounted for reciprocal movement to operate at least one set of contacts mounted to said frame;

a housing attached to the outer end of said plunger for reciprocal movement therewith and said housing having a viewing portion at its outer end;

a fixed member attached to said frame and extending into said housing, said member having a forward portion including a surface area visible through said viewing portion of said housing wherein said forward portion is alternately positioned adjacent to and spaced apart from said viewing portion in response to the reciprocal movement of said housing;

a sensor having a pair of electrodes, said sensor being mounted on said forward portion of said fixed member whereby the distance between said electrodes and said one set of contacts is fixed;

at least one shutter member rotatably mounted within said housing adjacent said viewing portion, and said shutter engaging said fixed member for rotation between first and second positions in response to relative movement between said fixed member and said housing wherein said shutter exposes said sensor when said fixed member is adjacent said viewing portion and wherein said shutter conceals said sensor when said fixed member is spaced apart from said viewing portion; and means electrically coupling said electrodes with said one set of contacts to control the output of said sensor in response to movement of said housing.

2. The push-button sensor switch according to claim 1, wherein said sensor is a light sensitive resistor.

3. The push-button sensor switch according to claim 2, wherein said fixed member includes a recess at said surface area receiving said resistor therein.

4. The push-button sensor switch according to claim 3, wherein said fixed member comprises a generally U-shaped member having first and second legs extending from a transverse portion which forms said forward portion.

5. The push-button sensor switch according to claim 4, wherein each of said legs includes guide means for receiving an electrical lead wire of an electrical connection to one of said electrodes.

6. The push-button sensor switch according to claim 5, wherein two shutter members are rotatably mounted within said housing and which are respectively rotated in opposite angular directions and wherein the ends of said shutter members meet at the approximate center line of said push-button sensor switch.

7. The push-button sensor switch according to claim 6, wherein said shutter members are pivotally mounted to said housing.

8. The push-button sensor switch according to claim 7, wherein said shutter members are substantially L-shaped, wherein one leg of each of said shutter members is disposed behind said transverse portion of said U-shaped member when said shutter members expose said resistor and wherein the respective pivotal mounting extends over a given length of said housing.

9. The push-button sensor switch according to claim 8, wherein one of said legs includes a snap-in fastener projection which is received in an aperture of said frame for locking engagement therewith.

10. The push-button sensor switch according to claim 9, wherein said housing includes a window at said viewing portion and wherein said shutter members include indicia thereon for displaying the operating state of said push-button sensor switch.

11. In a reciprocally operated push-button switch of the type having mechanical indicating means in the form of a reflective signal surface arranged behind a window of a push-button head and fixedly mounted to the switch frame by means of support legs, wherein said signal surface is located adjacent said window when the push-button head is depressed and spaced apart from said window when the push-button head returns to its initial position and wherein at least one shutter member is rotatably disposed within said push-button head for engagement with the signal surface structure for concealing said signal surface in response to relative movement of said push-button head with respect to said signal surface and when said signal surface is spaced apart from said window, the improvement therewith comprising:

a light sensitive resistor sensor;

means fixedly mounting said sensor adjacent said signal surface wherein said sensor is immediately adjacent said window and visible therefrom when said push-button head is depressed, wherein said sensor is substantially concealed when said push-button head returns to said initial position and wherein the position of said sensor is fixed relative to said switch frame; and means fixedly mounted to said switch frame for coupling the terminals of said sensor to an external electrical utilization device.

12. The apparatus according to claim 11, wherein said push-button switch includes at least one set of switch contacts fixedly mounted to said switch frame and coupled with said terminals of said sensor and responsive to the reciprocal movement of said push-button head for controlling the output of said sensor.

* * * * *